US005515141A

United States Patent [19]

Hanson

[11] Patent Number: 5,515,141

[45] Date of Patent: May 7, 1996

[54] IN-LINE TUBULAR MIXING DEVICE FOR LIQUID ELECTROPHOTOGRAPHIC PURPOSES

[75] Inventor: Gary Hanson, Meridian, Id.

[73] Assignee: Hewlett-Packard Company, Palo Alto, Calif.

[21] Appl. No.: 382,772

[22] Filed: Feb. 2, 1995

[51] Int. Cl.[6] ..... G03G 15/10

[52] U.S. Cl. ..... 355/256; 118/659; 118/660; 118/661

[58] Field of Search ..... 355/256, 257, 355/258; 118/659–662

[56] References Cited

U.S. PATENT DOCUMENTS

| | | | |
|---|---|---|---|
| 3,392,708 | 7/1968 | Hunstiger | 355/256 |
| 3,561,400 | 2/1971 | Smitzer et al. | 118/661 |
| 3,609,029 | 9/1971 | Egnaczak | 355/256 |
| 4,325,627 | 4/1982 | Swidler et al. | 118/661 |
| 4,327,664 | 5/1982 | Ohkawa et al. | 118/661 |
| 4,437,755 | 3/1984 | Sakurayama et al. | 355/256 |
| 4,761,357 | 8/1988 | Tavernier et al. | 118/661 X |
| 5,069,128 | 12/1991 | Hara et al. | 355/300 |
| 5,142,334 | 8/1992 | Iemura et al. | 355/256 |
| 5,153,659 | 10/1992 | Maiefski et al. | 355/256 |
| 5,157,443 | 10/1992 | Anderson et al. | 355/256 |
| 5,387,760 | 2/1995 | Miyazawa et al. | 118/661 |

FOREIGN PATENT DOCUMENTS

| | | | |
|---|---|---|---|
| 1441655 | 7/1976 | United Kingdom | 355/256 |

*Primary Examiner*—Matthew S. Smith

[57] ABSTRACT

An electrophotographic printer such as a laser printer uses a liquid toner solution in order to deliver toner having a small toner particle size. In order to maintain homogeneity of the liquid toner solution, an in-line mixer is used in the supply to an immersion bath for the developer roller. In order to further enhance mixing, return fluid from the developer roller is scraped from the developer roller with a scraper blade. The return fluid is reintroduced into the fluid supply stream through a nozzle arrangement which controls flow to the an immersion bath for the roller.

20 Claims, 5 Drawing Sheets

IN-LINE TUBULAR MIXING DEVICE FOR LIQUID ELECTROPHOTOGRAPHIC PURPOSES

CROSS-REFERENCE TO RELATED APPLICATION

This application shares common subject matter with U.S. patent application 08/382,773, for Liquid Toner Extraction Apparatus for Electrophotographic Equipment, commonly assigned, and filed on an even date herewith.

FIELD OF THE INVENTION

This invention relates to electrophotographic printing, such as used on laser printers. More particularly, the invention relates to maintaining agitation of electrophotographic toner fluid in order to maintain homogeneity of liquid toner solution in electrophotographic equipment.

BACKGROUND OF THE INVENTION

In electrophotographic printing, a pattern of electrostatic charges corresponding to a print image is applied to an optical photoreceptor (OPR). Toner is applied to the OPR and that toner which is retained as a result of not being repelled by electrostatic charges is used to form the print image. The print image is then transferred to a print media (usually paper).

The OPR may use either visible spectrum light or optical energy outside the visible light spectrum. In the preferred embodiment, it is anticipated that infrared light will be used, but the OPR as described in connection with this invention is intended to mean any photoreceptor which responds to radiated energy.

In the case of laser printing, the surface of the OPR is charged, and the image is created by selectively exposing the charged surface to light (the laser). The exposure to light results in the depletion of surface charges.

The OPR is usually a continuous surface such as a drum or belt, and is used repeatedly for subsequent sequential print operations. The toner applied to the OPR during each print operation must be removed from the OPR, except in the pattern of the print image, prior to transfer of the print image from the OPR.

The toner is commonly delivered either as a powder or as a liquid emulsion, referred to in the art as, "liquid toner." Liquid toner consists of solid toner particles suspended in a liquid carrier, and is sometimes also referred to as liquid emulsion toner. The image provided by liquid toner solution is provided by the solid toner particles, and liquid carrier is either recycled within the unit or is lost.

In the case of a liquid toner, the toner is applied to the charged OPR, and excess emulsion is allowed to drain off of the OPR. This leaves the OPR with a coating of emulsion. At locations where the OPR charge is depleted (typically by the laser light), toner particles from the emulsion are concentrated. This concentration of toner particles is the result of the particles not being repelled by electrostatic charge. The concentration of particles is referred to as developing the image. Excess toner which is not retained, as a result of the electrostatic charge repelling the particles, is not part of the image and may be referred to as "non-image toner."

In one arrangement, toner is applied to the OPR by a developer roller. The developer roller retains non-image toner which is repelled by the OPR. Some additional non-image toner may also be retained by the OPR, which may be subsequently removed. As a result of the OPR attracting particles, the non-image toner not retained by the developer roller is mostly superfluous carrier liquid, and tends to have a reduced solid component over that retained by the developer roller.

At locations on the OPR which are charged, toner particles are not retained by the OPR (the non-image toner). In the case of liquid toner, solid toner particles in the emulsion which are not retained by the developer roller as an image are subsequently removed. The action of applying of the liquid toner results in the toner particles which are not retained by the OPR being retained by the developer roller and potentially interfering with the proper subsequent transfer of toner to the OPR. In the present design, the remaining liquid from the liquid toner solution which is dispensed at a developer station and not removed by the development process is removed at an extraction station. At the extraction station, the non-image toner fluid which remains on the OPR has a substantially reduced solid toner content; that is, substantially devoid of toner particles.

The concentration of solid particles in liquid toner solution, as applied to the OPR, is typically in the range of 2% to 9%, as is the concentration of the solution in the toner supply. The toner being applied onto print media has approximately 97% solid concentration. (Percentages would be by volume and weight, since it is important that the specific gravities of the components be approximately equal.) This can be compared to starting with cloudy water at the development station, and ending up with visibly dry mud at the print media surface. In increasing these concentrations, it sometimes becomes difficult to transport and remove the emulsion.

After the OPR is coated, an additional amount of liquid from the liquid emulsion is removed by passing the coated OPR through a nib. The remaining material from the toner emulsion is then further dried and transferred to the print media.

Printer resolution is primarily a function of the size of the optical image generator (the laser or optics) and toner particle size. Typical solid toner laser printers, such as the Assignee's Laser Jet 4L™ printer, use dry toner having a toner particle size of approximately 5–7 microns (μM) diameter. It is desired to reduce particle size to approximately 0.2 μM by the use of liquid toner solution.

The present invention relates to a system for handling toner in which particle size is decreased. While liquid toner solution is used to facilitate smaller particle size, the smaller particle size imposes additional requirements on the toner delivery system. In particular, it is important to provide a means for evenly dispersing the emulsion and maintaining the emulsion at a consistent state.

The liquid toner solution must also be provided to the developer in a well mixed, homogenous, state. If return fluid from the developer station or elsewhere is mixed with toner from a supply reservoir, the toner from the supply reservoir will be homogeneous. This mixed return fluid makes it easier to maintain homogeneity of the toner after mixing with return fluid. Additionally, the toner from the supply reservoir typically has been standing for long time periods, and so may be subject to particles clumping, settling or other non-homogenizing effects. The toner which is coated onto the developer roller is likely to consist mostly of the toner supplied directly from the supply reservoir, so thorough homogenization of this toner results in an overall better quality printed image. Thorough homogenization of the toner from the supply reservoir also results in better control of particle separation at the developer and extraction stations, and therefore more precise development.

In our preferred system for delivering liquid toner solution, a developer roller is used to apply emulsion to the OPR. The emulsion is supplied to the developer roller which in turn transfers the emulsion to the OPR. A substantial amount of emulsion is removed from the OPR by virtue of the fact that the emulsion is electrostatically repelled from the OPR where the OPR is charged. Additional solids-depleted emulsion is removed at a nib pressure roller station.

Excess fluid on the OPR has a tendency to spread outwardly toward the edges of the OPR. This results in excess fluid along the edges where the fluid tends to wrap around at the edge of the OPR at the extraction nib roller due to capillary effects. It would be advantageous if this wrap around could be minimized or eliminated.

The developer roller has a tendency to be charged to a potential which is less than that of the charged portion of the OPR, but greater than ground potential. This tends to allow the developer roller to attract a pattern of toner which is essentially a negative image of that applied to the OPR. Unlike dry toner, liquid toner is electrically neutral; i.e., zero net charge, but consists of an equal amount of positively charged and negatively charged species. The core of the developer roller is maintained at a bias voltage, but liquid toner solution can provide an insulating film on the developer roller, insulating the surface of the roller. Furthermore, the negative image pattern attracted by the developer roller is separated from the emulsion and tends to remain on the developer roller.

It is advantageous to recover the non-image toner fluid in order to keep carrier consumption to a minimum, and hence keep toner consumption to a minimum. This also reduces the need to dispose of waste products. Therefore, it is desired to return as much of the non-image toner fluid as possible to the fluid reservoir without adversely affecting the quality of the toner fluid supplied from the reservoir. When applying the emulsion, that emulsion which is returned to the developer roller must be removed and properly mixed in order that the developing process not be adversely affected by the toner emulsion coating the developer roller.

In order to maintain a high print quality, it is desired to keep the surface of the OPR dry, except during the application of toner. If the OPR surface is wet or "soupy," the image will be diffused as the charge on the OPR surface is depleted. It is therefore desired to provide a system in which image drying is facilitated by extracting as much liquid component as possible from the surface of the OPR.

In general, it is desired to provide a system for delivering liquid toner which facilitates the enhancement of image resolution. It is also desired to permit the use of toner having smaller particle size, with a minimum of toner waste and with a minimum of mechanical complexity.

SUMMARY OF THE INVENTION

According to the invention, the developer roller is supplied with liquid toner solution which consists of solid toner particles suspended in a liquid carrier, and is sometimes referred to as, "liquid toner" or "liquid emulsion toner." The liquid toner is maintained in a homogeneous state by the use of a nozzle arrangement which controls flow of liquid toner solution which is supplied to an immersion bath for the roller.

According to a further aspect of the invention, a liquid toner delivery system is increased in efficiency by more effectively removing excess liquid from the developer and toner removal stations of an electrophotographic printer such as a laser printer. The excess liquid contains non-image toner which is recovered. The recovered fluid is mixed in order to assure adequate dispersion of toner onto the image. The redispersion assures that the quality of the fluid in the reservoir is maintained.

According to a further aspect of the invention, a developer roller is immersion coated with liquid toner solution and a scraper blade removes returned solids from the developer roller prior to re-coating of the roller. This permits return fluid to be properly reintroduced into the fluid supply stream without adversely affecting image quality while at the same time maintaining a homogeneous coating on the developer roller of fluid being supplied to the optical photoreceptor (OPR).

According to an alternate embodiment of the invention, a flexible web is used to remove the returned solids from the developer roller prior to re-coating of the roller. This enables the toner to be removed from the roller in a manner which also facilitates mixing the solid particles from the liquid emulsion toner. The web is drawn up to the developer roller by the movement of the fluid which accumulates between the web and the roller. This results in the web being drawn up to the circumference of the developer roller and effectively preventing the buildup of a film on the developer roller.

According to a further aspect of the invention, a developer roller is coated with liquid toner solution in an immersion bath in a manner which permits the toner fluid to more completely drain from the developer roller at the completion of application of toner for an image. This is accomplished by valving the fluid flow from a return portion of a fluid transfer immersion tray to a supply portion of the immersion tray. The fluid is valved off at the end of the image in order to reduce the fluid load on the OPR. Prior to the end of the image, toner solids which are scraped from the developer roller are allowed to mix with fluid supplied to the roller in the immersion bath. The fluid which is not supplied to the roller is allowed to return to a toner supply reservoir.

According to a further aspect of the invention, an absorptive nib roller is used to remove liquid toner solution from the OPR. This forms a nib for the purpose of separating toner from the OPR except at image locations. A pressure roller applies compressive force against the nib roller. The force applied by the pressure roller compresses the nib roller, thereby increasing the efficiency of the nib roller in removing fluid from the OPR. At the end of the image, pressure of the nib roller against the OPR is reduced and the nib roller reduces the compressive force against the nib. This is preferably accomplished by retraction of the nib roller.

If the volume of fluid delivered to the absorptive nib roller is reduced at the end of the image, then the combination of reduced volume and decompression of the nib roller permits the nib roller to more thoroughly remove non-image toner at the end of the image. The retraction of the nib roller has the further advantage that the nib roller is not impinged against the OPR when the electrophotographic printer is not in operation.

The invention is further enhanced by the use of a capillary drain between the developer roller and the absorptive nib roller station. The capillary drain is located close to the OPR and uses capillary attraction to drain toner fluid from the OPR. This reduces the load of non-image toner on the nib roller or other extraction device, and has the further advantage of reducing a tendency of toner fluid to travel transversely toward the edges of the OPR. It is thought that capillary attraction of the fluid, even where not sufficient to extract all of the non-image toner fluid, substantially exceeds the forces which cause the fluid to move transversely toward the edges of the OPR. In any case, the provision of a capillary drain removes excess fluid from the OPR and reduces the tendency of the fluid to form drip lines at roller disengagement points on the OPR. The removal of excess fluid from the OPR by the capillary drain also reduces capillary wraparound at the nib roller ends.

According to the invention, a system for electrophotographic printing is improved by the combination of efficient drainage, improved cleaning of the developer roller and placement of mixing nozzles or flow pathways to facilitate even dispersion of returned fluid with supplied fluid, along with the delivery of a thoroughly mixed liquid toner solution. The system is capable of increased print resolution, more efficient consumption of toner and lower maintenance costs.

DETAILED DESCRIPTION OF THE PREFERRED EMBODIMENTS

Figure 1:
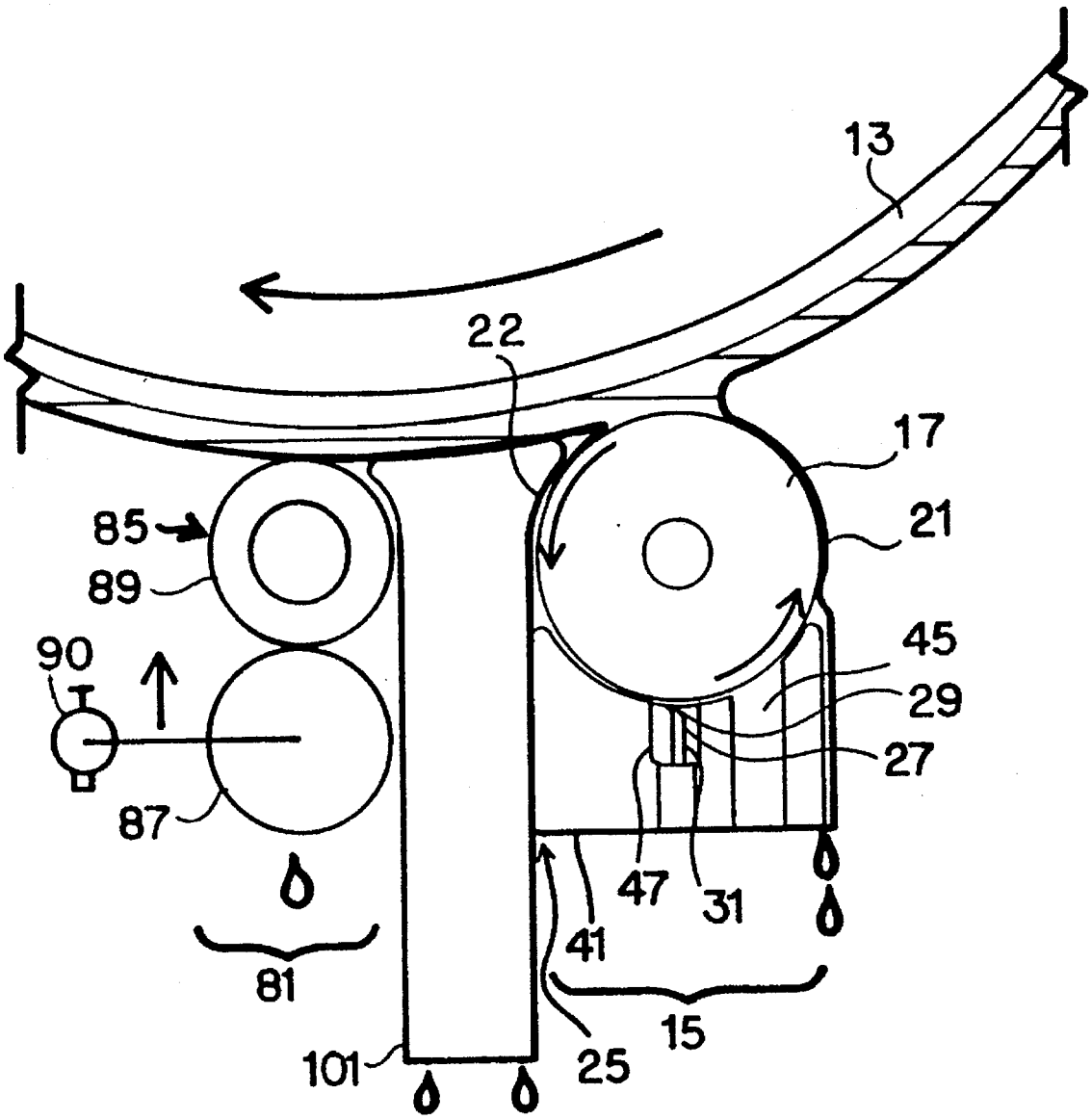
FIG. 1 shows a cross-sectional view of a developer station used in electrophotographic printing, according to a preferred embodiment of the present invention.

Referring to FIG. 1, an optical photoreceptor (OPR) 13 is shown at a developer station 15. In the preferred embodiment, the OPR 13 is a cylindrical drum (shown), although it is contemplated that other configurations for the OPR 13, such as a continuous sheet in the form of a belt, will be useful.

The OPR 13 is usually a continuous surface such as a drum, roller or belt, and is used repeatedly for subsequent sequential print operations. It is possible to use a noncontinuous surface, in which case the mechanical positioning mechanism for the various stations accommodates the noncontinuous surface. The toner applied to the OPR 13 during each print operation must thereafter be removed from the OPR, except in the pattern of the print image, prior to transfer of the print image from the OPR.

In the preferred embodiment, toner is delivered as a liquid emulsion to the OPR 13, referred to in the art as, "liquid toner" or "liquid toner solution." Excess emulsion is allowed to drain off of the OPR. At locations on the OPR 13 where the electrostatic charge of OPR 13 is depleted, toner particles from the emulsion are concentrated. At locations on the OPR 13 which remain electrostatically charged, toner particles are not retained by the OPR 13 and are subsequently removed (the non-image toner).

A cycling transfer medium, which in the preferred embodiment is a developer roller 17, is used to deliver the liquid toner to the OPR 13. While the preferred embodiment of the cycling transfer medium is the developer roller 17 in the form of a cylinder, it is possible to use various configurations, such as partial cylinders or continuous sheets.

The delivery of liquid toner to the OPR 13 is by the developer roller 17 is shown at 21, which transfers the liquid toner to the OPR 13. The liquid toner is supplied to the developer roller 17 which in turn transfers the emulsion to the OPR 13. A substantial amount of emulsion is removed from the OPR 13 by virtue of the fact that the non-image toner is not attracted to the OPR 13 where the OPR 13 is electrostatically charged. This results in the developer roller 17 picking up or retaining excess emulsion from the OPR 13. This return emulsion is shown at 22.

Particularly with smaller toner particle size used to facilitate higher resolution, the smaller particle size imposes additional requirements on the toner delivery system. In particular, it is important to evenly disperse the emulsion and maintain the emulsion at a consistent state.

The liquid toner 22 which is returned by the developer roller is scraped from the developer roller 17, and escapes through drain slot 25. This has the effect of permitting mixing of return fluid 22 with supplied fluid for later reapplication to the developer roller 17. This is also believed to facilitate providing fluid from the developer roller 17 in an electrostatic charge-free state. If a coating of fluid is allowed to remain on the developer roller 17, the fluid establishes an insulating film on the developer roller 17. This results in the surface of the developer roller 17 accepting an electrostatic charge from the OPR 13, and thereby inhibiting the ability of the developer roller 17 to accept fresh liquid toner. It is also believed that if fluid is permitted to remain on the developer roller 17, that toner particles will accumulate on the developer roller 17, deteriorating the ability of the developer roller 17 to transfer toner to the OPR 13. During normal operation, the developer roller 17 becomes charged to a potential which is typically intermediate between ground potential and that of the charged portion of the OPR 13. This results in toner particles becoming attracted to the surface of the developer roller 17, and separated from the liquid component of the liquid toner solution.

A mechanical cleaning blade 27 is used to remove the deposited solids from the developer roller 17 prior to reapplication of liquid toner. The cleaning blade 27 can be made of any suitable construction, but is preferably made of a material which is substantially softer than the corresponding contact surface of the developer roller 17. In the preferred embodiment, the cleaning blade 27 is made from a low friction plastic, whereas the surface of the developer roller 17 is polished stainless steel. The cleaning blade 27 is preferably positioned within the apparatus in an interference fit against the developer roller 17.

The preferred construction of the cleaning blade 27 is that of a single blade portion 29 having an edge which is positioned against the developer roller 17 at an acute angle. The angle is chosen so as to facilitate thorough cleaning of the developer roller 17 with a minimum of pressure against the developer roller 17, and yet permit the cleaning blade 27 to be self-sharpening. Since the pressure applied by the cleaning blade 27 to the developer roller 17 is radial, the cleaning blade 27 has a body portion 31 which is correspondingly angled to be substantially normal to the surface of the developer roller 17. Therefore, the blade portion 29 preferably forms an obtuse angle with the body portion 31 of the cleaning blade 27. The cleaning blade 27 is biased against the developer roller 17 within a predetermined range of force. The blade 27 must exert sufficient force against the developer roller 17 to remove most solid toner particles from the developer roller 17 and prevent a buildup of solid toner particles on the developer roller. The force of the blade 27 against the developer roller 17 should be less than would cause excessive wear of the blade 27 or developer roller 17. Ideally, the force of the blade 27 against the developer roller 17 should be less than 200% of the force required to remove most solid toner particles from the developer roller 17. In the preferred embodiment, this is accomplished by the dimensions of the blade and the physical position of the body portion 31, and by the flexibility of the blade portion 29. Therefore, in effect the cleaning blade 27 includes a cantilever scraper, which is the blade portion 29.

The cleaning blade is preferably supported by an immersion tray 41, within the drain slot 25. The primary function of the immersion tray 41 is the delivery of liquid toner to the developer roller 17. The immersion tray 41, receives the liquid toner from a supply source (not shown in FIG. 1), which is typically a supply reservoir. The liquid toner from the supply source is dispensed to the developer roller 17 in an immersion bath at supply aperture 45. The developer roller 17, in its rotational motion (anticlockwise in the drawing) passes the supply aperture 45, where liquid toner coats the developer roller 17 in sufficient quantity to transfer sufficient liquid toner onto the OPR 13 to provide the desired image.

The liquid toner on the developer roller 17 then is carried by the developer roller 17 to the OPR 13 as a result of the rotation of the developer roller 17. The liquid toner forms a meniscus between the developer roller 17 and OPR 13, partially because of the relative movement of the developer roller 17 and the OPR 13. On the downstream side of the point of closest contact of the developer roller 17 with the OPR 13, non-image toner is allowed to drain back by coating the developer roller 17. The developer roller 17 may, as a result of being coated with toner, receive some electrostatic charge from the OPR 13. This is because the toner can under certain circumstances, form an insulative film on the developer roller 17. As a result, the developer roller 17 can itself become charged, and have a reduced ability of transporting a quantity of liquid toner to the OPR 13. The purpose of the cleaning blade 27 is to remove this film. This has the effect of presenting the supply aperture 45 with a clean surface of the developer roller 17. Since the developer roller 17 is made of electrically conductive material, the clean surface also permits the developer roller 17 to discharge any electrostatic charge generated on the surface of the developer roller 17.

The process of removing these particles also tends to mix the particles with fluid which is also expressed from the developer roller 17 by the cleaning blade 27. A return fluid aperture 47 receives the fluid which is expressed by the cleaning blade 27. The fluid from the return fluid aperture 47 is permitted to return to the supply reservoir where it is mixed with fluid to be supplied to the supply aperture 45. This permits a control of mixing of return fluid with freshly supplied fluid. The mixture of return fluid and fresh supply fluid is provided to the developer roller through the supply aperture 45. It is believed that the quality of the mixed fluid approximates that of the liquid toner which was originally in the supply reservoir supply source, presumably because solid particulate loss compensates for evaporation or carry out of fluid.

Figure 2:
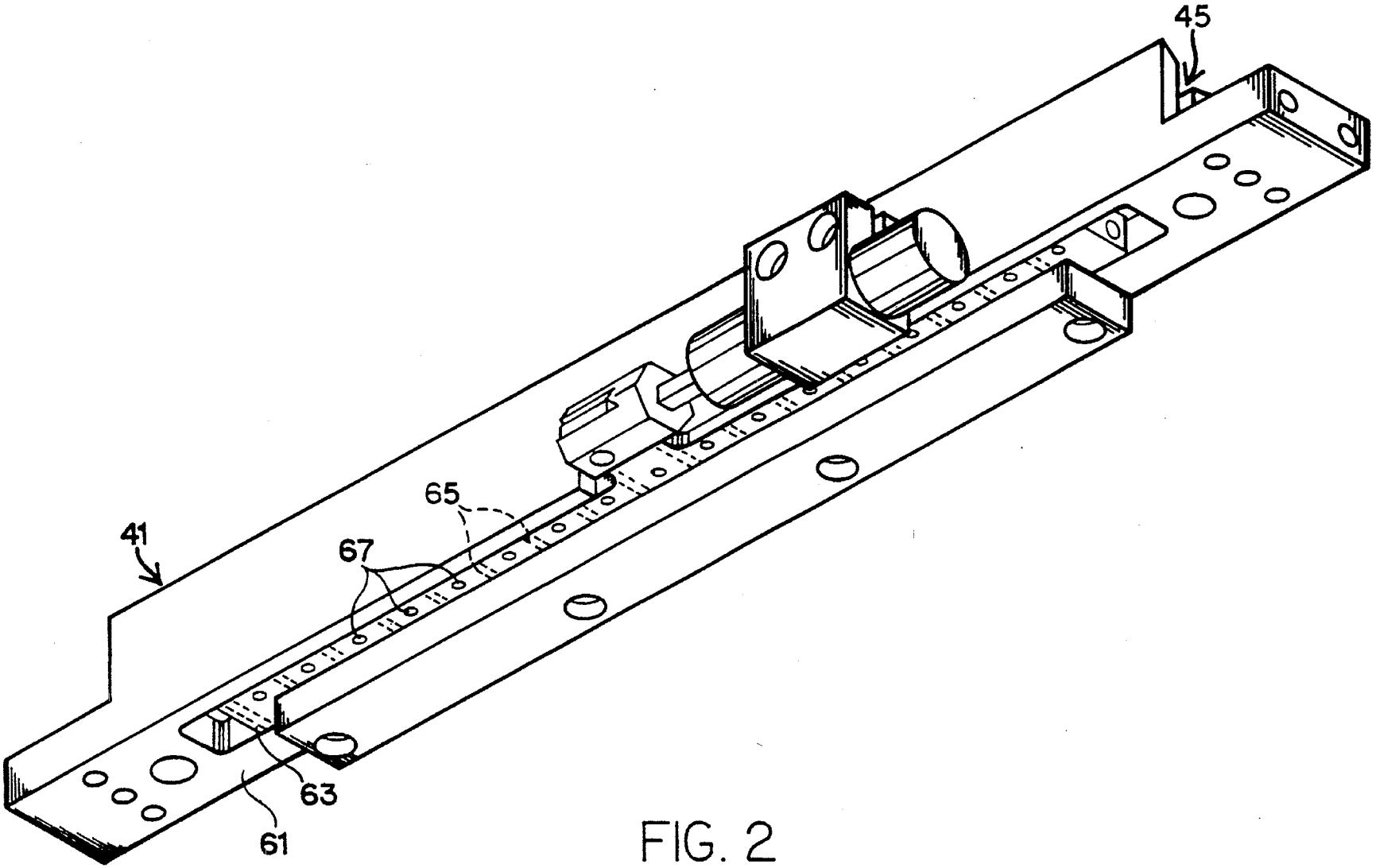
FIG. 2 shows details of a shuttle valve for controlling fluid flow to the immersion developer roller, and which incorporates a shuttle valve.

FIG. 2 shows a shuttle valve assembly 61 for controlling the supply of toner fluid. The shuttle valve 61 is positioned on the immersion tray 41 to control flow of fluid flow into the supply aperture 45 and the return fluid aperture 47 (FIG. 1). The shuttle valve 61 includes a shuttle 63 having a plurality of fluid pathways 65, 67 to control fluid to flow. Cross flow fluid pathways 65 permit a significant quantity of supplied fluid to flow to the supply fluid aperture 45 in a first shuttle position. In addition, the cross flow fluid pathways 65 permit a quantity of supplied fluid to flow to the return fluid aperture 47 (FIG. 1), thereby assisting in the return of the non-image toner from the fluid aperture. The supplied fluid flushes the return fluid aperture 47 and thereby helps to prevent accumulation of solid particles. In addition, the flushing of the return fluid helps maintain the homogeneity of the fluid returned to the supply reservoir. A second set of fluid pathways 67 permit drainage of substantially all fluid in the supply aperture when the shuttle 63 is in a second shuttle position. The second shuttle position also interrupts fluid flow to the supply aperture 45 and increases fluid flow into the return fluid aperture 47. The increased fluid flow enhances the flushing of the return fluid aperture 47.

The fluid pathways 65, 67 are spaced in the shuttle 63 to align with a corresponding plurality of nozzle openings (not shown) in a valve body 71. The long dimension of the shuttle valve 61 extends parallel to the axes of the developer roller 17 and OPR 13. This length corresponds to a predetermined coating width, and assures that return fluid is evenly dispersed across the supply aperture 45.

At the end of an image, there is a tendency for liquid toner to accumulate on the OPR 13. Since no image is desired at this point, it is desired to enhance the drainage of fluid from the OPR 13 by reducing the amount of fluid which is supplied to the OPR 13. For this reason, a servo mechanism 73 moves the shuttle 63 to the second shuttle position at the end of the image. In the second shuttle position, the shuttle 63 valves off the flow of fluid through the second set of fluid pathways in the shuttle 63. That allows fluid which has been applied to the developer roller 17 to be applied to the OPR 13 for the duration of the image, but decreases the amount of fluid applied to the developer roller at the end to the image.

The valving off of the flow of fluid at the end of the image also has the effect of increasing fluid flow on the wash side of the cleaning blade 27, shown in FIG. 1. This assists in reducing buildup of solid material on the cleaning blade 27.

Referring again to FIG. 1, after passing the developer roller 17, the OPR 13 passes a nib station 81. The purpose of the nib station 81 is to remove non-image toner which had not drained from the OPR 13 at the developer station 15. The intent is to leave toner on the OPR 13 in the pattern of the desired image and to remove the non-image toner where the OPR 13 is not electrostatically charged.

The nib station 81 in our preferred embodiment includes a nib roller 85 which contacts the OPR 13, and a pressure roller 87. The pressure roller 87 does not contact the OPR 13, but instead contacts the nib roller 85. The nib roller 85 has an outer layer of spongy material 89 which is normally compressed against the OPR 13.

The spongy material 89 is porous and has a capability of absorbing the toner fluid from the OPR 13. The liquid toner which is absorbed is primarily non-image toner which had not drained from the OPR 13 prior to reaching the nib station 81. A preferred material for the spongy material 89 is an open cell polyethylene foam with a pore size of less than 50 μM.

The pressure roller also compresses the spongy material 89 on the nib roller 85, thereby extracting the fluid which had been absorbed by the nib roller 85. This has the effect of causing the nib roller 85 to compress against the OPR 13. At the end of the image, the pressure roller 87 is retracted from the nib roller 85. This in turn allows the nib roller 85 to retract from the OPR 13.

In the preferred embodiment, the nib roller 85 is compressed against the OPR 13 within a range of 40% to 60% compression of the spongy material 89. This leaves toner on the surface of the OPR 13 which consists of between 80% and 100% solid material, whereas the freshly supplied liquid toner contains approximately 2% solid material. The absorbent material (spongy material 89) on the nib roller 85 facilitates this reduction of the toner on the OPR to over 80% solid material.

In the compression phase, the capacity of the spongy material is effectively reduced, causing excess non-image toner to drain off of the nib roller 85. The nib roller 85 increases its ability to absorb the excess non-image toner during the decompression phase of its revolution. When the nib roller 85 is compressed to 80–90% by the pressure roller 87, the absorbed solution is expelled, presenting a relatively dry sponge to repeat the process. The relative geometries at the OPR 13 and the pressure roller 87 define the relative compressions of the spongy material 89 on the nib roller 85. Thus, a given force applied by the pressure roller 87 controls the compression of the spongy material 89 at both the OPR 13 and the pressure roller 87.

The retraction of the nib roller 85 results in reducing the compression of the nib roller 85 against the OPR 13, thereby increasing the absorption of non-image toner from the OPR 13 at the end of the image. In addition, there is a tendency for fluid absorbed by the OPR 13 to spread outwardly toward the edges of the nib roller 85. This generates a wrap-around edge effect, similar to that experienced in using a paint roller or pad.

At the end of the cycle (end of the image), small amounts of fluid are anticipated. In order to enhance absorbency of the nib roller 85 at the end of the image, the pressure roller 87 is retracted. This results in compression of the nib roller 85 by the pressure roller 87 being reduced at the same time that the nib roller 85 is decompressed against the OPR. The nib roller 85 thereby increases its total absorbency.

In the preferred embodiment, the nib roller 85 is pressed against the OPR 13 by the pressure roller 87. An actuator 90 causes the pressure roller 87 to compressively engage the nib roller 85. When the pressure roller 87 is retracted, the nib roller 85 is simultaneously decompressed from the OPR 13, so that the total pressure of compression of the nib roller 85 against the OPR 13 is equal to the total compression of the nib roller 85 against the pressure roller 87. This results in the retraction of the pressure roller 87 from the nib roller 85 being effected substantially simultaneously with the retraction of the nib roller 85 from the OPR 13.

Therefore, in the configuration of the preferred embodiment, the total pressure of compression of the nib roller 85 against the OPR 13 is equal to the total pressure of compression of the nib roller 85 against the pressure roller 87. This total pressure of compression remains equal both during nib operation and during the retraction of the nib roller 85 from the OPR 13.

In the preferred embodiment, the retraction of the pressure roller 87 from the nib roller directly controls the retraction of the pressure roller 87 from the OPR 13. It is, of course, alternatively possible to provide a mechanism to retract the pressure roller 87 from the nib roller 85 either before the retraction of the nib roller 85 is retracted from the OPR 13, or even slightly after the nib roller 85 begins to be retracted from the OPR 13.

It is also possible to cause the pressure roller 87 to again compressively engage the nib roller 85 after retraction of the nib roller 85 from the OPR 13. This would result in further extraction of fluid from the nib roller 85 prior to the next cycle, but has not been found necessary in the preferred embodiment of the invention.

Figure 3:
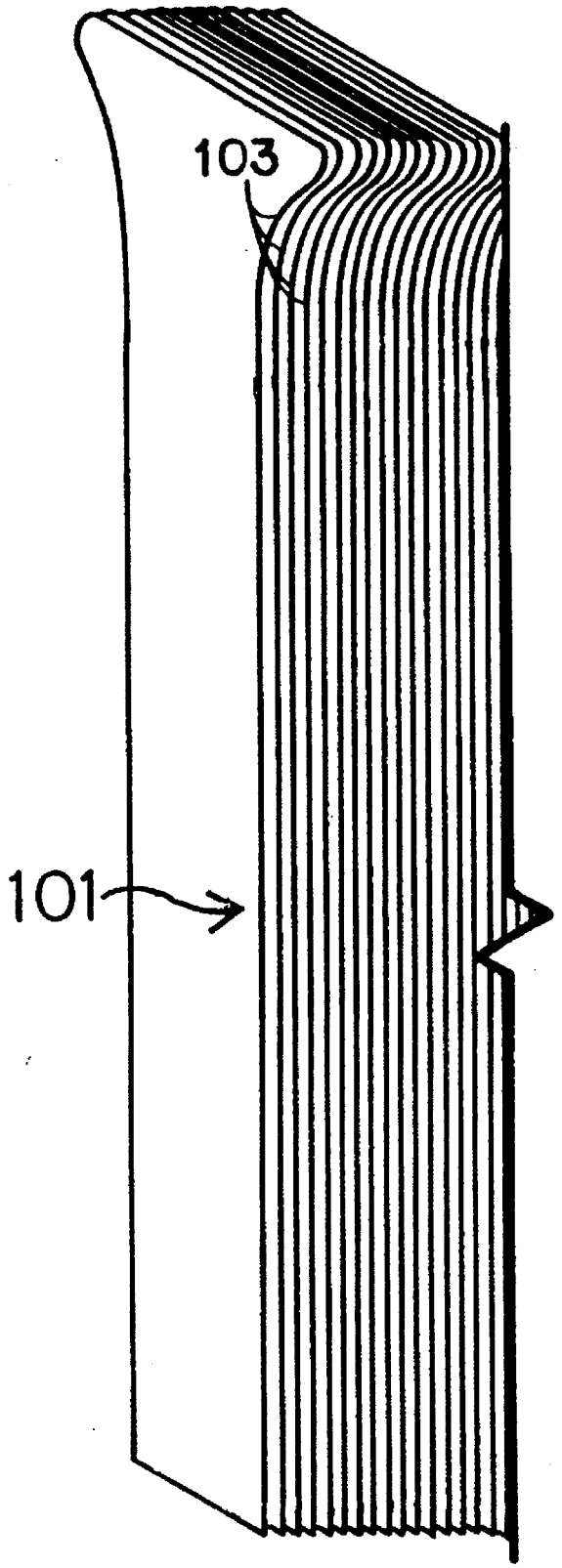
FIG. 3 shows details of a capillary drain which is used to enhance drainage of non-image toner.

In order to further decrease the tendency of the non-image toner to form drip lines and to decrease the volume of fluid which is handled by the nib roller 85, a capillary drain 101 is provided, as shown in FIGS. 1 and 3. The capillary drain 101 is positioned closely adjacent to the OPR 13 and attracts, by capillary action, the non-image toner. The capillary drain 101 extends across the full width of the OPR 13, and includes a plurality of fins 103, which are spaced to encourage capillary flow of fluid away from the OPR 13.

In the preferred embodiment, this spacing is such that a gap of 0.25 mm exists between adjacent fins 103. This gap should be optimized to the hydrophilic properties of the toner solution and the material used for the fins. The fins should be vertically long enough to create sufficient gravity head to allow the solution to drain from the fins.

The capillary drain 101 further decreases a tendency to form drip lines along the edges of the image because the capillary attraction of the fluid is believed to counteract the tendency of the non-image toner to spread across the OPR 13. Thus, the capillary drain 101 causes the fluid to drain away from the OPR instead of spreading outwardly. Advantageously, the capillary drain 101 exhibits mechanical complexity only in the necessity to align the capillary drain 101 in close proximity to the OPR 13 without directly contacting the OPR 13. Therefore, the capillary drain 101 enhances fluid extraction with very little requirement for its own maintenance, thereby reducing overall maintenance of the electrophotographic equipment.

The fins 103 are arranged parallel to the direction of movement of the OPR 13. This permits movement of fluid on the OPR 13 and in the capillary drain 101 close to the OPR 13 to be in a direction parallel to the direction of movement of the OPR 13, rather than across the OPR 13. In the preferred embodiment, the fins 103 are parallel to each other, although it is possible to arrange the fins 103 to be canted away from the direction of movement of the OPR 13 (e.g., inwardly). It is regardless desirable that the fins 103 be generally parallel to each other, at least to an extent necessary to retard movement of the non-image toner transversely across the OPR 13 toward the edges of the OPR 13. The fins 103 should extend in an arc around the OPR 13 to a length sufficient to attract fluid from the OPR 13, should a significant quantity of fluid be present on the OPR 13. The length of the arc that the fins 103 extend around the OPR 13 is limited by the difficulty in accurately aligning the capillary drain 101 into close proximity to the OPR 13, and also by the limitations in available space between the developer roller 17 and the nib roller 85. It is considered sufficient to align the capillary drain 101 so that at least one portion of the drain is in close proximity to the OPR 13.

It is further likely that the combination of the capillary drain with the nib roller 85 and the retractable pressure roller 87 also has the advantage of permitting efficient removal of non-image toner under a variety of conditions. This combination is particularly advantageous when a large quantity of non-image toner is present on the OPR 13. The combination facilitates removing quantities of fluid, even when the quantity of non-image toner coated onto the OPR 13 may vary.

Figure 4:
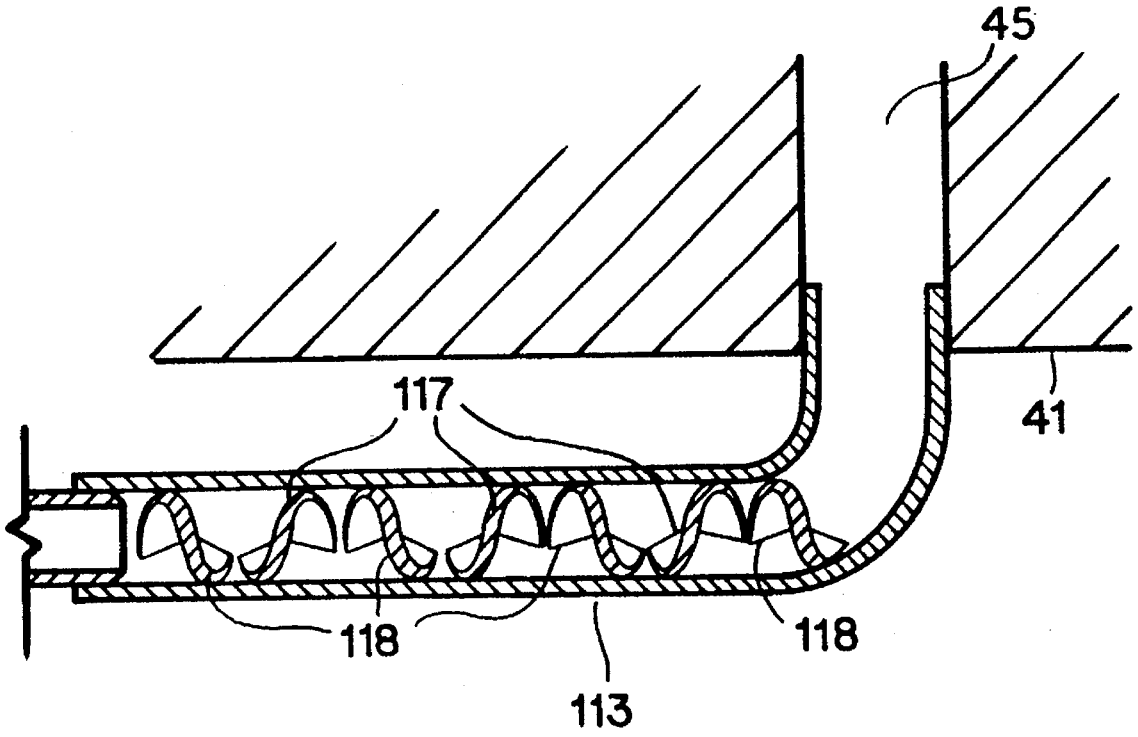
FIG. 4 shows details of a mixing tube used to provide supplied fluid in a homogeneous state.

FIG. 4 shows an in-line delivery mixer 113 for delivering fresh liquid toner to the supply aperture 45 (FIG. 1) in the immersion tray 41. The liquid toner is believed to be reasonably homogeneous in its stored state; however, mixing assures that clumping of solid particles in the liquid toner solution is minimized. In addition, the ability to replenish stored toner with used non-image toner also is enhanced by more thoroughly mixing the liquid toner. It is further anticipated that in higher resolution printers, more active mixing of toner fluid will be required. The in-line delivery mixer 113 will enhance homogeneity of the fluid by performing a mixing function.

As can be seen in FIG. 4, the in-line delivery mixer 113 preferably consists of a plurality of counterdirectional helix vanes 117, 118. Alternate sequential vanes 117, 118, direct fluid clockwise and counterclockwise. This causes the fluid in the in-line delivery mixer 113 to shear (in a fluid sense) as the fluid passes the sequential vanes 117, 118. The shear results in a forced turbulence of fluid in the mixer 113, and mixes the fluid. FIG. 4 shows the sequential vanes 117, 118 as being spaced apart for clarity of the depiction. It is, however, anticipated that the vanes 117, 118 will overlap in their positions along a common center axis. This type of mixer was used in a delivery system for 5-minute type epoxy produced by 3M® (Minnesota Mining and Manufacturing of Minneapolis, Minn.), marketed as an "EPX™ Applicator." In the epoxy delivery system, fluid from two tubes with mechanically linked plungers is mixed after expulsion from the tubes, and the mixer mixes the epoxy upon delivery. This, of course precludes re-use of the mixer tube, which is not the case when used in the present invention with liquid toner.

The counterdirectional helix vanes 117, 118 are the configuration for the in-line mixer in the preferred embodiment. It is noted that the result of mixing fluid by establishing a turbulence of the fluid prior to being supplied to the supply aperture 45 in the immersion tray 41 can be accomplished in a number of ways. It is also possible to provide for such turbulent action in the immersion tray 41 itself, as exemplified by the above-mentioned shuttle valve 61 for controlling the mixing of return fluid with freshly supplied fluid.

It is noted that the in-line delivery mixer 113 does not in itself present any moving parts. Therefore, mixing of the fluid is enhanced with a minimum of mechanical complexity. Thus the in-line delivery mixer 113 itself adds a minimum of mechanical complexity, while accomplishing the described mixing function. In addition, the in-line delivery mixer is capable of performing its function even if significant quantities of fluid must be returned to the supply reservoir.

Figure 5:
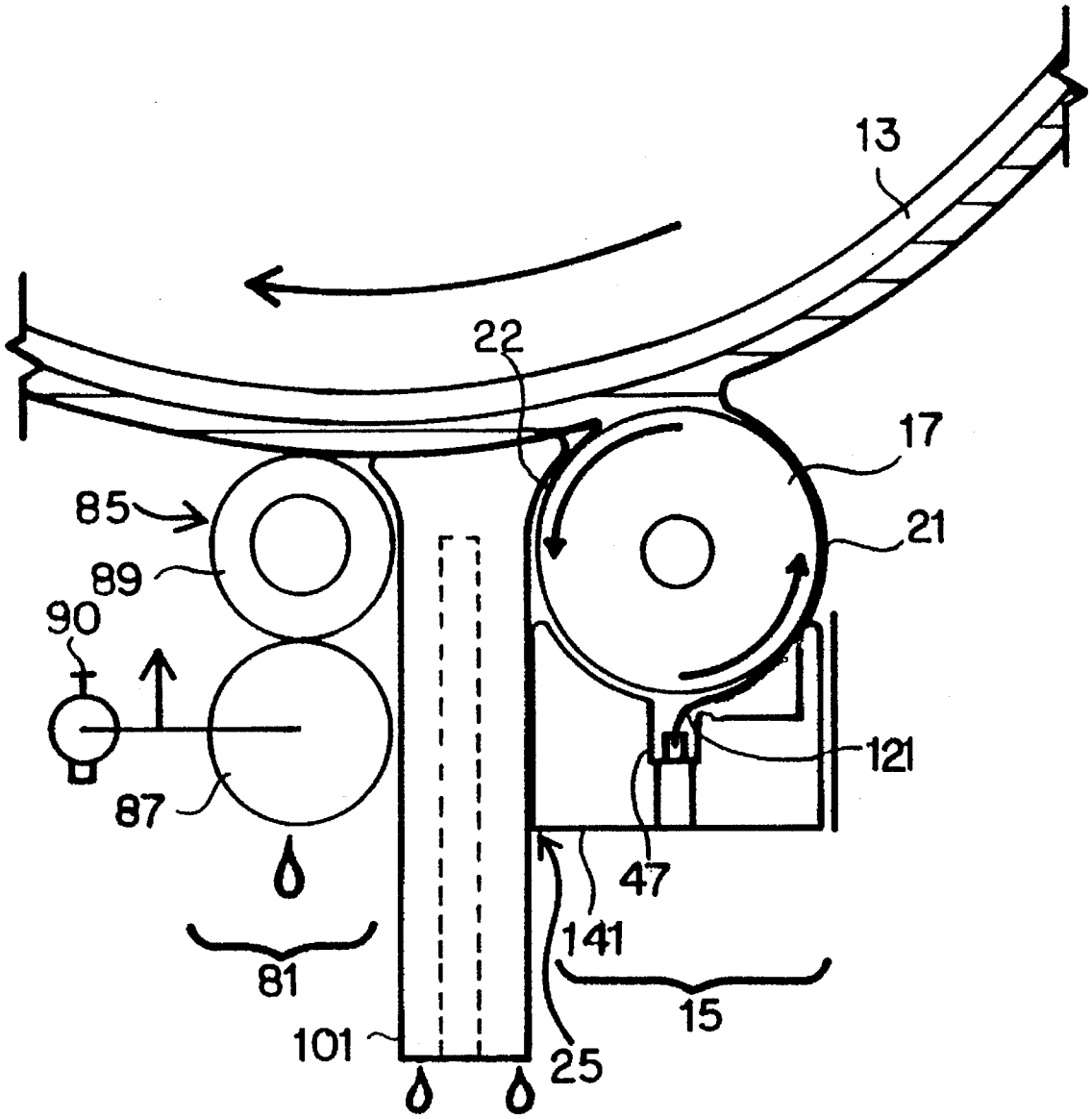
FIG. 5 shows an alternate embodiment of the invention, in which a flexible web is used to remove the returned solids from the developer roller.

FIG. 5 shows an alternate technique for maintaining homogeneity of toner fluid. A flexible web 121 is supported within an immersion tray 141 used to remove the returned solids from the developer roller 17 prior to re-coating of the roller 17. While the flexible web 121 is shown in lieu of the blade 27 (FIG. 1), it is also possible to use both the blade 27 and the flexible web 121 in the same apparatus. It is also possible to provide the flexible web 121 elsewhere, such as directly adjacent the OPR 13.

The flexible web 121 enables the toner to be removed from the roller in a manner which also facilitates mixing the solid particles from the liquid toner. The web is drawn up to the developer roller 17 by the movement of the fluid which accumulates between the web 121 and the roller 17. This results in the web 17 being drawn up to the circumference of the developer roller 121 and effectively preventing the buildup of a film on the developer roller 17.

The supply of liquid toner to the flexible web 121 is advantageous in that the liquid toner flushes the web 121. This flushing of the web tends to retard particle buildup on the web 121, so that the web 121 does not rapidly clog. Therefore, the housing of the flexible web 121 in the immersion tray 141 is advantageous in that the flexible web is not in a dry air environment, and therefore there is less tendency for solid toner particles to accumulate on the web 121.

The web 121 is preferably woven material. In the configuration used for testing the invention, a clean wiping rag, which is believed to be woven polyester was used. The polyester has the advantage that it has a property of withdrawing toner, and therefore encouraging transfer of the liquid component of the liquid toner. It has been found that the flexible web 121 can also effectively deliver fresh toner to the OPR, as shown at 21. Alternatively, it is possible to form the flexible web 121 from non-woven material, such as felt.

As mentioned above, there are various ways of accomplishing the various mechanical functions described. For example, the retraction of the pressure roller 87 from the nib roller 85 and the retraction of the nib roller 85 from the OPR 13 may be effected with different timings. This may be accomplished by gear action, or by electronically controlled solenoids. It is possible to supplement the pressure roller 87 with additional rollers for the purpose of enhancing fluid extraction from the nib roller 85. It is also possible to provide different combinations of extraction devices, such as a capillary drain and a different type of nib. It is therefore anticipated that the invention should be limited in scope only by the claims.

What is claimed is:

1. Apparatus for delivering and retrieving liquid toner solution to an optical photoreceptor (OPR) on an electrophotographic printing device, the OPR having a direction of movement, wherein a cycling transfer medium provides liquid toner solution, deposited onto the cycling transfer medium as a liquid toner solution film, to the OPR by means of a cycling transfer medium, and the cycling transfer medium transfers the liquid toner solution to the OPR by passing in close proximity to the OPR, the apparatus comprising:

a. a supply reservoir for holding liquid toner solution;

b. a delivery bath for providing fresh liquid toner solution to the cycling transfer medium, thereby applying the liquid toner solution film to the cycling transfer medium;

c. a supply connection for supply of said liquid toner solution from the supply reservoir to the delivery bath; and d. the supply connection including an in-line delivery mixer, the in-line delivery mixer including means for establishing a turbulence of the fluid prior to supply of the fluid to the delivery bath, said turbulence being established by the structure of the in-line delivery mixer without moving parts.

2. Apparatus for delivering and retrieving liquid toner solution as described in claim 1, the in-line delivery mixer further comprising:

a plurality of counterdirectional vanes, whereby alternate sequential vanes direct fluid clockwise and counterclockwise, thereby causing the fluid in the in-line delivery mixer to shear as the fluid passes the sequential vanes.

3. Apparatus for delivering and retrieving liquid toner solution as described in claim 1, further comprising:

a. a contact location on the cycling transfer medium, the liquid toner solution film placed in contact with the OPR to an extent sufficient for a charge pattern on the OPR to attract toner particles in the liquid toner solution to the OPR, at least a portion of that liquid toner solution not attracted to the OPR retained by the cycling transfer medium as return fluid;

b. a wiper, positioned against the cycling transfer medium so as to contact the cycling transfer medium, for removing the return fluid from a surface of the cycling transfer medium, the wiper comprising an edge which effects said contact, and a biasing mechanism for urging the edge against the cycling transfer medium;

c. a drain for accepting the return fluid after removal from the cycling transfer medium by the wiper; and d. a fluid passageway for mixing said liquid toner solution from the supply reservoir with fluid from the drain.

4. Apparatus for delivering and retrieving liquid toner solution as described in claim 3, the cycling transfer medium further comprising:

a developer roller having a cylindrical contoured surface, so that said surface comprises at least a cylindrical section.

5. Apparatus for delivering and retrieving liquid toner solution as described in claim 3, said biasing mechanism for urging the edge of the wiper against the cycling transfer medium further comprising:

a body portion of the wiper, with the edge which effects said contact resiliently extending as a cantilever extension from the body portion of the wiper, the wiper positioned within the apparatus in an interference fit against the cycling transfer medium.

6. Apparatus for delivering and retrieving liquid toner solution as described in claim 3, the wiper further comprising:

a cleaning blade including a blade portion positioned against the cycling transfer medium, and a body portion, wherein the blade portion resiliently extends as a cantilever extension from the body portion.

7. Apparatus for delivering and retrieving liquid toner solution as described in claim 3, further comprising:

a. a valving mechanism for controlling said supply of liquid toner solution from the supply reservoir to the delivery bath and to the drain; and b. the fluid passageway for mixing said liquid toner solution from the supply reservoir with fluid from the drain includes a plurality of nozzles arranged in a row extending substantially across a dimension of the delivery bath corresponding to a width dimension of the cycling transfer medium whereby the return fluid is distributed across the delivery bath.

8. Apparatus for delivering and retrieving liquid toner solution as described in claim 1, further comprising:

a. a drain for accepting return fluid after removal from the cycling transfer medium by a wiper;

b. a valving mechanism for controlling said supply of liquid toner solution from the supply reservoir to the delivery bath and to the drain; and c. a fluid passageway for mixing said liquid toner solution from the supply reservoir with fluid from the drain wherein said fluid passageway includes including a plurality of nozzles arranged in a row extending substantially across a dimension of the delivery bath corresponding to a width dimension of the cycling transfer medium which distribute the return fluid across the delivery bath.

9. Apparatus for delivering and retrieving liquid toner solution as described in claim 1, further comprising:

a drain for accepting fluid after removal from the cycling transfer medium by a wiper, a mixing nozzle and valving mechanism selectively controlling the supply of liquid toner solution to the delivery bath and the drain, the mixing nozzle and the valving mechanism including a sliding bar shuttle valve having a plurality of nozzles arranged in a row extending substantially across a dimension of the delivery bath corresponding to a width dimension of the cycling transfer medium which distributes said liquid toner solution from the supply reservoir across the delivery bath.

10. Apparatus for delivering and retrieving liquid toner solution to an optical photoreceptor (OPR) on an electrophotographic printing device; the OPR having a direction of movement, wherein a cycling transfer medium provides liquid toner solution, deposited onto the cycling transfer medium as a liquid toner solution film, to the OPR by means of a cycling transfer medium, and the cycling transfer medium transfers the liquid tone solution to the OPR by passing in close proximity to the OPR, the apparatus comprising:

a. a supply reservoir for holding liquid toner solution;

b. a delivery bath for providing fresh liquid toner solution to the cycling transfer medium, thereby applying the liquid toner solution film to the cycling transfer medium;

c. a supply connection for supply of said liquid toner solution from the supply reservoir to the delivery bath;

d. the supply connection including an in-line delivery mixer, the in-line delivery mixer including means for establishing a turbulence of the fluid prior to supply of the fluid to the delivery bath;

e. a contact location on the cycling transfer medium, the liquid toner solution film placed in contact with the OPR to an extent sufficient for a charge pattern on the OPR to attract toner particles in the liquid toner solution to the OPR, at least a portion of that liquid toner solution not attracted to the OPR retained by the cycling transfer medium as return fluid;

f. a wiper, positioned against the cycling transfer medium so as to contact the cycling transfer medium, for removing the return fluid from a surface of the cycling transfer medium, the wiper comprising an edge which effects said contact, and a biasing mechanism for urging the edge against the cycling transfer medium;

g. a drain for accepting the return fluid after removal from the cycling transfer medium by the wiper; and h. a fluid passageway for mixing said liquid toner solution from the supply reservoir with fluid from the drain; and i. a cleaning blade including a blade portion positioned against the cycling transfer medium so as to form an acute angle with the surface of the cycling transfer medium, and a body portion extending away from the blade portion at an angle substantially normal from the surface of the cycling transfer medium, wherein the blade portion resiliently extends at an obtuse angle as a cantilever extension from the body portion.

11. Apparatus for delivering and retrieving liquid toner solution as described in claim 10, further comprising:

said angle of the cleaning blade portion and the surface of the cycling transfer medium chosen so as to facilitate thorough cleaning of the cycling transfer medium with a minimum of pressure against the cycling transfer medium, and yet permit the cleaning blade portion to self-sharpen.

12. Apparatus for delivery and retrieving liquid toner solution to an optical photoreceptor (OPR) on an electrophotographic printing device, the OPR having a direction of movement, wherein a cycling transfer medium provides liquid toner solution, deposited onto the cycling transfer medium as a liquid toner solution film, to the OPR by means of a cycling transfer medium, and the cycling transfer medium transfers the liquid toner solution to the OPR by passing in close proximity to the OPR, the apparatus comprising:

a. a supply reservoir for holding liquid toner solution;

b. a delivery bath for providing fresh liquid toner solution to the cycling transfer medium, thereby applying the liquid toner solution film to the cycling transfer medium;

c. a supply connection for supply of said liquid toner solution from the supply reservoir to the delivery bath;

d. the supply connection including an in-line delivery mixer, the in-line delivery mixer including means for establishing a turbulence of the fluid prior to supply of the fluid to the delivery bath;

e. a contact location on the cycling transfer medium, the liquid toner solution film placed in contact with the OPR to an extent sufficient for a charge pattern on the OPR to attract toner particles in the liquid toner solution to the OPR, at least a portion of that liquid toner solution not attracted to the OPR retained by the cycling transfer medium as return fluid;

f. a wiper, positioned against the cycling transfer medium so as to contact the cycling transfer medium, for removing the return fluid from a surface of the cycling transfer medium, the wiper comprising an edge which effects said contact, and a biasing mechanism for urging the edge against the cycling transfer medium;

g. a drain for accepting the return fluid after removal from the cycling transfer medium by the wiper; and h. a fluid passageway for mixing said liquid toner solution from the supply reservoir with fluid from the drain; and i. a mixing nozzle and a valving mechanism for controlling said supply of liquid toner solution from the supply reservoir to the delivery bath and to the drain and thereby controlling the supply of liquid toner solution from the supply to the delivery bath and to the drain.

13. Apparatus for delivering and retrieving liquid toner solution as described in claim 12, wherein:

said mixing nozzle and valving mechanism includes a sliding bar shuttle valve having a plurality of fluid passageways arranged in a row extending substantially across a dimension of the delivery bath corresponding to a width dimension of the cycling transfer medium for distributing fluid passing through the mixing nozzle and valving mechanism.

14. Apparatus for delivering and retrieving liquid toner solution to an optical photoreceptor (OPR) on an electrophotographic printing device, the OPR having a direction of movement, the liquid toner solution provide to the OPR by means of a cycling transfer medium, the liquid toner solution deposited onto the cycling transfer medium as a liquid toner solution film and the cycling transfer medium transferring the liquid toner solution to the OPR by passing in close proximity to the OPR, the apparatus comprising:

a. a contact location on the cycling transfer medium, the liquid toner solution film placed in contact with the OPR to an extent sufficient for a charge pattern on the OPR to attract toner particles in the liquid toner solution to the OPR, at least a portion of that liquid toner solution not attracted to the OPR retained by the cycling transfer medium as return fluid;

b. a supply reservoir for holding liquid toner solution;

c. a delivery bath for providing fresh liquid toner solution to the cycling transfer medium, thereby applying the liquid toner solution film to the cycling transfer medium;

d. a supply connection for supply of said liquid toner solution from the supply reservoir to the delivery bath;

e. a wiper, positioned against the cycling transfer medium so as to contact the cycling transfer medium, for removing the return fluid from a surface of the cycling transfer medium, the wiper comprising an edge which effects said contact, and a biasing mechanism for urging the edge against the cycling transfer medium;

f. a drain for accepting the return fluid after removal from the cycling transfer medium by the wiper; and g. a fluid passageway for mixing said liquid toner solution from the supply reservoir with fluid from the drain; including a plurality of nozzles arranged in a row extending substantially across a dimension of the delivery bath corresponding to a width dimension of the cycling transfer medium, thereby distributing the return fluid across the delivery bath; and h. a valving mechanism for controlling said supply of liquid toner solution from the supply reservoir to the delivery bath and to the drain.

15. Apparatus for delivering and retrieving liquid toner solution as described in claim 14, further comprising:

the cycling transfer medium formed as a developer roller having a cylindrical contoured surface, so that said surface comprises at least a cylindrical section.

16. Apparatus for delivering and retrieving liquid toner solution as described in claim 14, said biasing mechanism for urging the edge of the wiper against the cycling transfer medium further comprising:

a body portion of the wiper, with the edge which effects said contact resiliently extending as a cantilever extension from the body portion of the wiper, the wiper positioned within the apparatus in an interference fit against the cycling transfer medium.

17. Apparatus for delivering and retrieving liquid toner solution as described in claim 14, the wiper further comprising:

a cleaning blade including a blade portion positioned against the cycling transfer medium, and a body portion, wherein the blade portion resiliently extends as a cantilever extension from the body portion.

18. Apparatus for delivery and retrieving liquid toner solution to an optical photoreceptor (OPR) on an electrophotographic printing device, the OPR having a direction of movement, the liquid toner solution provided to the OPR by means of a cycling transfer medium, the liquid toner solution deposited onto the cycling transfer medium as a liquid toner solution film and the cycling transfer medium transferring the liquid toner solution to the OPR by passing in close proximity to the OPR, the apparatus comprising:

a. a contact location on the cycling transfer medium, the liquid toner solution film placed in contact with the OPR to an extent sufficient for a charge pattern on the OPR to attract toner particles in the liquid toner solution to the OPR, at least a portion of that liquid toner solution not attracted to the OPR retained by the cycling transfer medium as return fluid;

b. a supply reservoir for holding liquid toner solution;

c. a delivery bath for providing fresh liquid toner solution to the cycling transfer medium, thereby applying the liquid toner solution film to the cycling transfer medium;

d. a supply connection for supply of said liquid toner solution from the supply reservoir to the delivery bath;

e. a wiper, positioned against the cycling transfer medium so as to contact the cycling transfer medium, for removing the return fluid from a surface of the cycling transfer medium, the wiper comprising an edge which effects said contact, and a biasing mechanism for urging the edge against the cycling transfer medium;

f. a drain for accepting the return fluid after removal from the cycling transfer medium by the wiper;

g. a fluid passageway for mixing said liquid toner solution from the supply reservoir with fluid from the drain; and h. a cleaning blade including a blade portion positioned against the cycling transfer medium so as to form an acute angle with the surface of the cycling transfer medium, and a body portion extending away front the blade portion at an angle substantially normal from the surface of the cycling transfer medium, wherein the blade portion resiliently extends at an obtuse angle as a cantilever extension from the body portion, said angle of the cleaning blade portion and the surface of the cycling transfer medium chosen so as to facilitate thorough cleaning of the cycling transfer medium with a minimum of pressure against the cycling transfer medium, and yet permit the cleaning blade portion to self-sharpen.

19. Method for delivering and retrieving liquid toner solution to an optical photoreceptor (OPR) on an electrophotographic printing device, the OPR having a direction of movement, wherein a cycling transfer medium provides liquid toner solution, deposits the liquid toner solution onto the cycling transfer medium as a liquid toner solution film, and the cycling transfer medium transfers the liquid toner solution to the OPR by passing in close proximity to the OPR, the method comprising:

a. supplying liquid toner solution to a delivery bath;

b. applying the liquid toner solution from the delivery bath to the cycling transfer medium as a film;

c. establishing turbulence in the liquid toner as solution as providing an in-line delivery mixer in a supply connection to the delivery bath, the in-line delivery mixer including means for establishing a turbulence of the fluid by causing the fluid in the in-line delivery mixer to shear prior to supplying the fluid to the delivery bath, said turbulence being established without having parts.

20. Method for delivering and retrieving liquid toner solution to an optical photoreceptor (OPR) on an electrophotographic printing device, the OPR having a direction of movement, wherein a cycling transfer medium provides liquid toner solution, deposits the liquid toner solution onto the cycling transfer medium as a liquid toner solution film, and the cycling transfer medium transfers the liquid toner solution to the OPR by passing in close proximity to the OPR, the method comprising:

a. supplying liquid toner solution to a delivery bath;

b. applying the liquid toner solution from the delivery bath to the cycling transfer medium as a film;

c. establishing turbulence in the liquid toner as solution as providing an in-line delivery mixer in a supply connection to the delivery bath, the in-line delivery mixer including means for establishing a turbulence of the fluid prior to supplying the fluid to the delivery bath; and d. using a valving mechanism for controlling said supply of liquid toner solution from the supply reservoir to the delivery bath and to a drain, thereby controlling the supply of liquid toner solution from the supply to the delivery bath and to the drain.

* * * * *